US012035773B2

(12) United States Patent
Stallone

(10) Patent No.: US 12,035,773 B2
(45) Date of Patent: Jul. 16, 2024

(54) LIGHT FUNNELED ILLUMINATED EDGE DECORATION ASSEMBLY AND METHOD

(71) Applicant: Bill R. Stallone, Eagan, MN (US)

(72) Inventor: Bill R. Stallone, Eagan, MN (US)

( * ) Notice: Subject to any disclaimer, the term of this patent is extended or adjusted under 35 U.S.C. 154(b) by 50 days.

(21) Appl. No.: 17/859,771

(22) Filed: Jul. 7, 2022

(65) Prior Publication Data

US 2024/0008574 A1 Jan. 11, 2024

(51) Int. Cl.
*A41G 1/00* (2006.01)

(52) U.S. Cl.
CPC ..... *A41G 1/005* (2013.01)

(58) Field of Classification Search
CPC ..... A41G 1/005; H05B 33/10
USPC ..... 264/21; 428/26
See application file for complete search history.

(56) References Cited

U.S. PATENT DOCUMENTS 4,789,572 A * 12/1988 Weaver ..... A41G 1/00 156/61
5,508,070 A * 4/1996 DiLapo ..... A41G 1/00 156/61

FOREIGN PATENT DOCUMENTS

JP 04052200 A * 2/1992
KR 20030019041 A * 3/2003

OTHER PUBLICATIONS

Machine translation of KR 20030019041 A dated Mar. 2003. (Year: 2003).*
Machine translation of JP-040552200-A dated Feb. 1992. (Year: 1992).*

* cited by examiner

*Primary Examiner* — Robert B Davis

(57) ABSTRACT

A light funneled illuminated edge decoration assembly includes a support shaft having a bottom end and a top end. Each of a plurality of decorative elements is comprised of a single, unitary panel. The decorative elements each have a central area with an aperture extending therethrough. The support shaft is extendable through the apertures to allow the decorative elements to be stacked on each other. Each of the decorative elements has an upper surface and a lower surface each being non-planer. The decorative elements are each comprised of a fluorescent acrylic material. A retention member is mounted on the support shaft and releasably engages the decorative elements to retain the decorative elements on the support shaft.

9 Claims, 6 Drawing Sheets

LIGHT FUNNELED ILLUMINATED EDGE DECORATION ASSEMBLY AND METHOD

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to garden decoration devices and more particularly pertains to a new garden decoration device for providing an ornament having the ability to capture and direct ambient light in such a manner that an outer periphery of the ornament appears to be glowing or illuminated. Additionally, the decorative device is modular to allow multiple variations and additions for a finished decoration.

(2) Description of Related Art Including Information Disclosed Under 37 CFR 1.97 and 1.98

The prior art relates to garden decoration devices include those items placed within a garden to mimic flowers, insects, fanciful creatures, and the like. However, such devices do not typically have the ability to glow or appear to emit light utilizing ambient light.

BRIEF SUMMARY OF THE INVENTION

An embodiment of the disclosure meets the needs presented above by generally comprising a support shaft having a bottom end and a top end. A plurality of decorative elements are provided and each is comprised of a single, unitary panel. The decorative elements each have a central area with an aperture extending therethrough. The support shaft is extendable through the aperture in each of the decorative elements to allow the decorative elements to be stacked on each other. Each of the decorative elements has an upper surface and a lower surface each being non-planer. The decorative elements are each comprised of a fluorescent acrylic material. A retention member is mounted on the support shaft and releasably engages each of the decorative elements positioned on the support shaft to retain the decorative elements on the support shaft.

In another embodiment, a method is taught providing a plurality of decorating elements each having a centrally located aperture therein. A support shaft extends through the apertures in at least two of the decorative elements to mount the decorative elements in on the support shaft. The decorative elements each have an upper surface and a lower surface. The upper and lower surfaces are non-planer, and each of the decorative elements is comprised of a fluorescent acrylic material.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
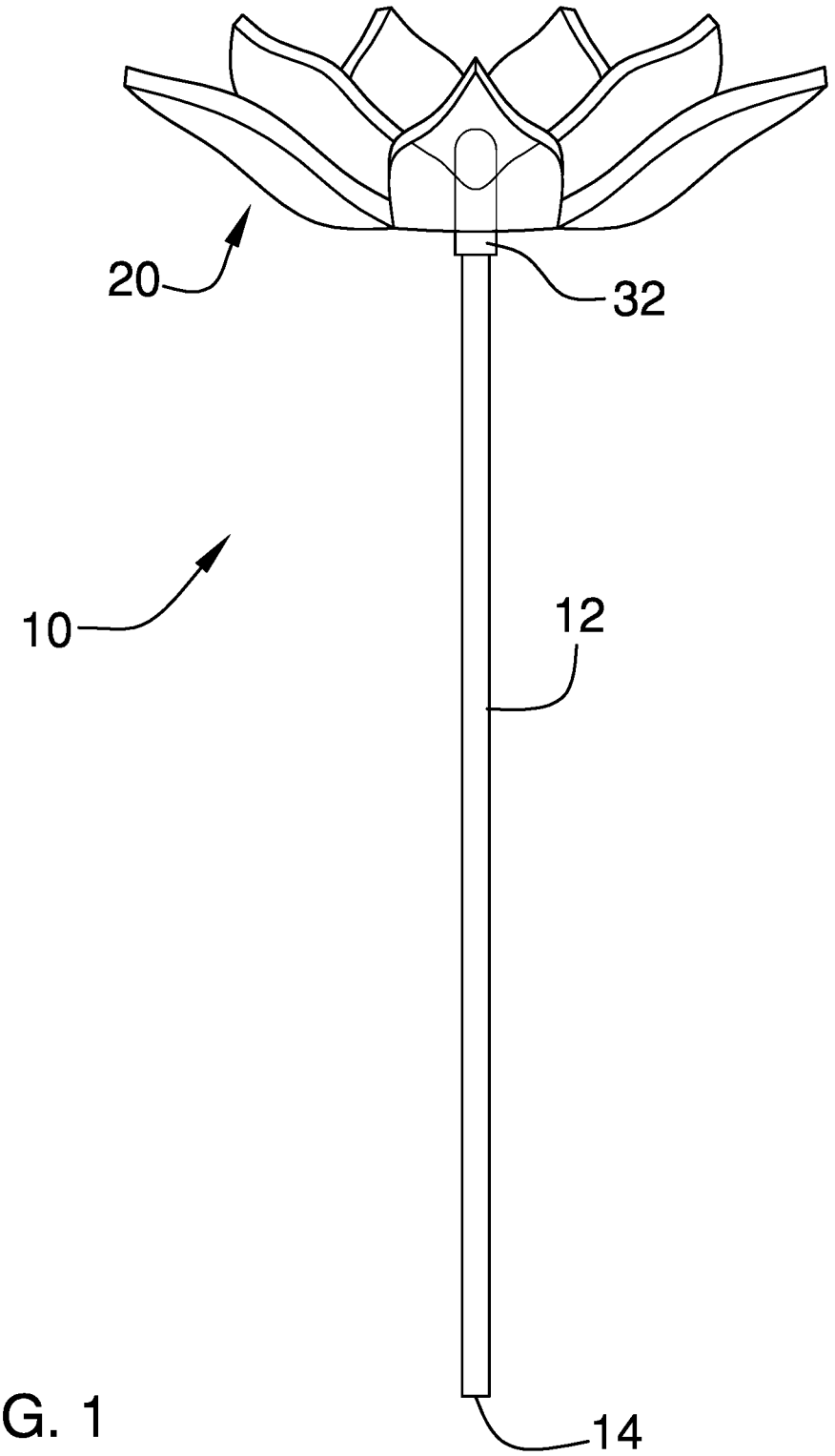
FIG. 1 is a side view of a light funneled illuminated edge decoration assembly and method according to an embodiment of the disclosure.
Figure 2:
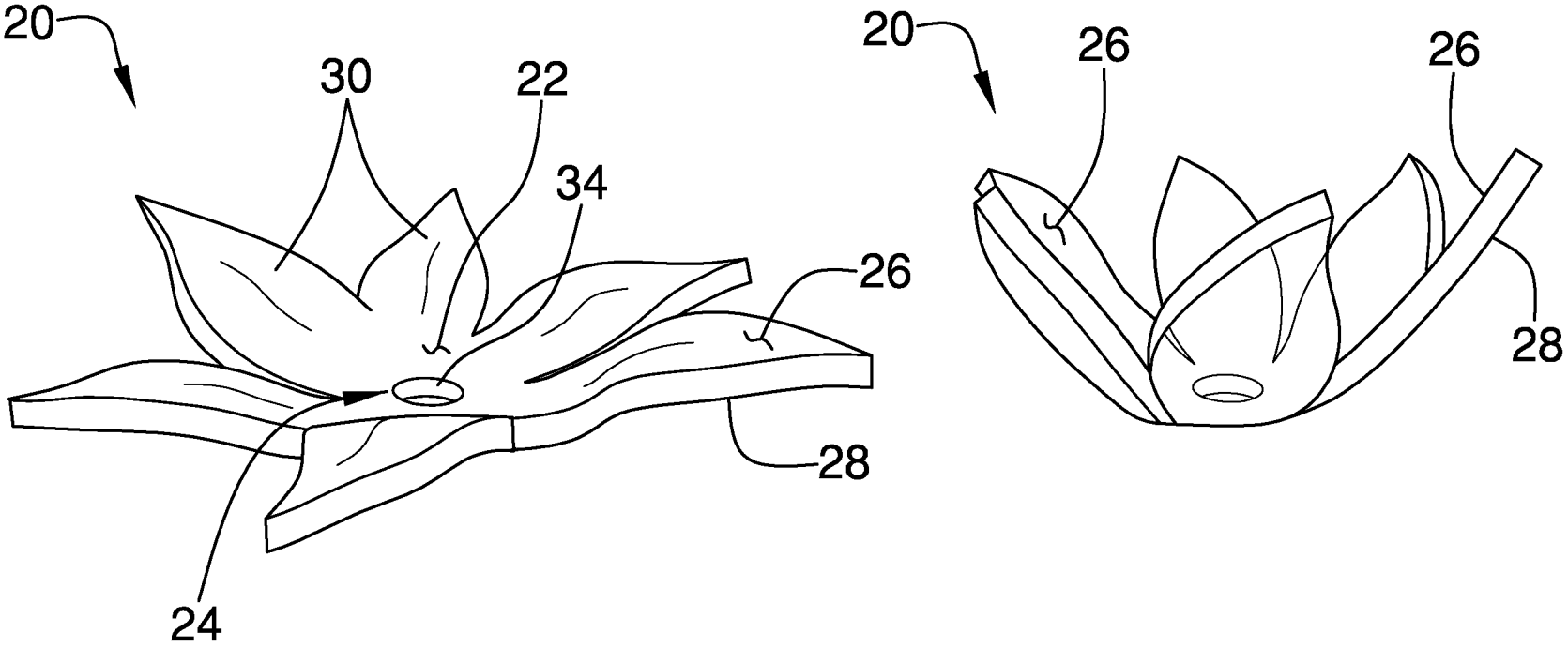
FIG. 2 is a side isometric view of an embodiment of the disclosure showing a pair of decorative elements.

With reference now to the drawings, and in particular to FIGS. 1 through 6 thereof, new garden decoration devices embodying the principles and concepts of an embodiment of the disclosure and generally designated by the reference numeral 10 will be described.

Figure 3:
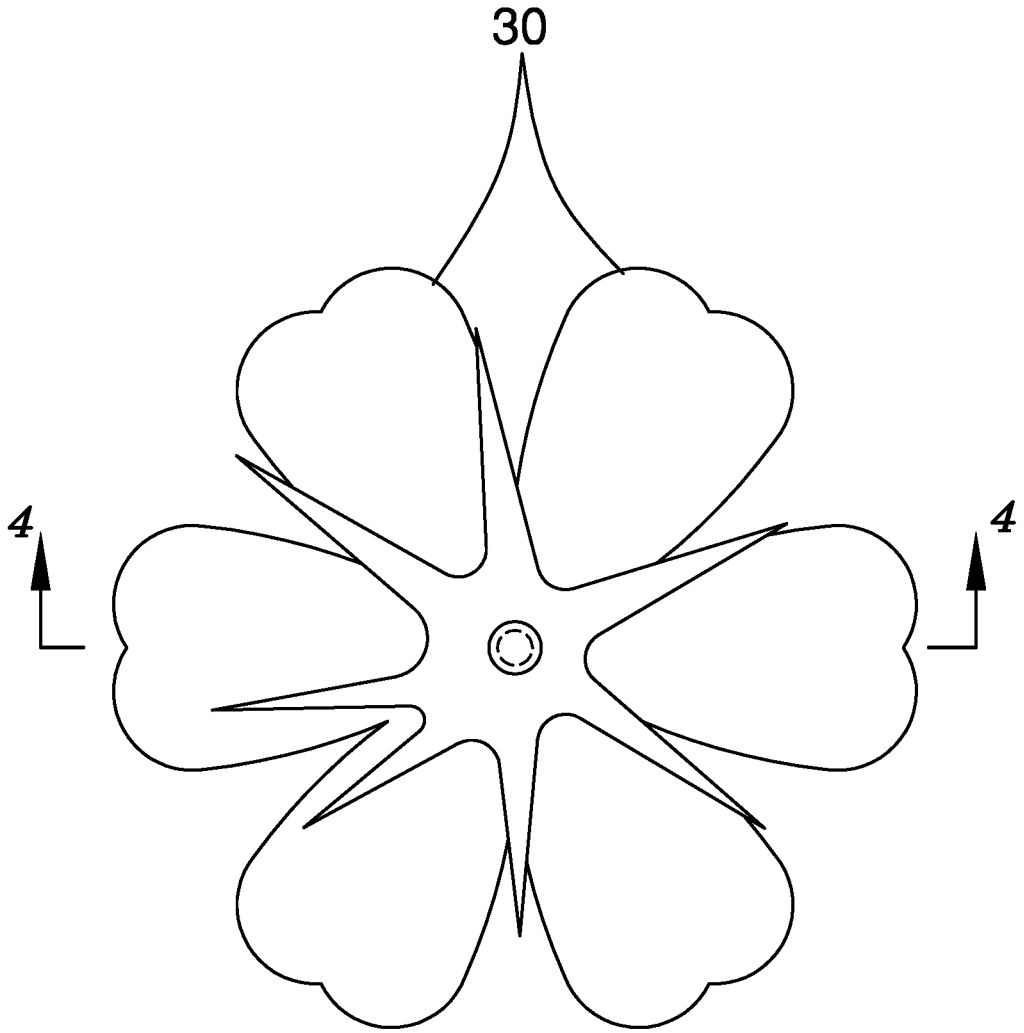
FIG. 3 is a top view of an embodiment of the disclosure.
Figure 4:
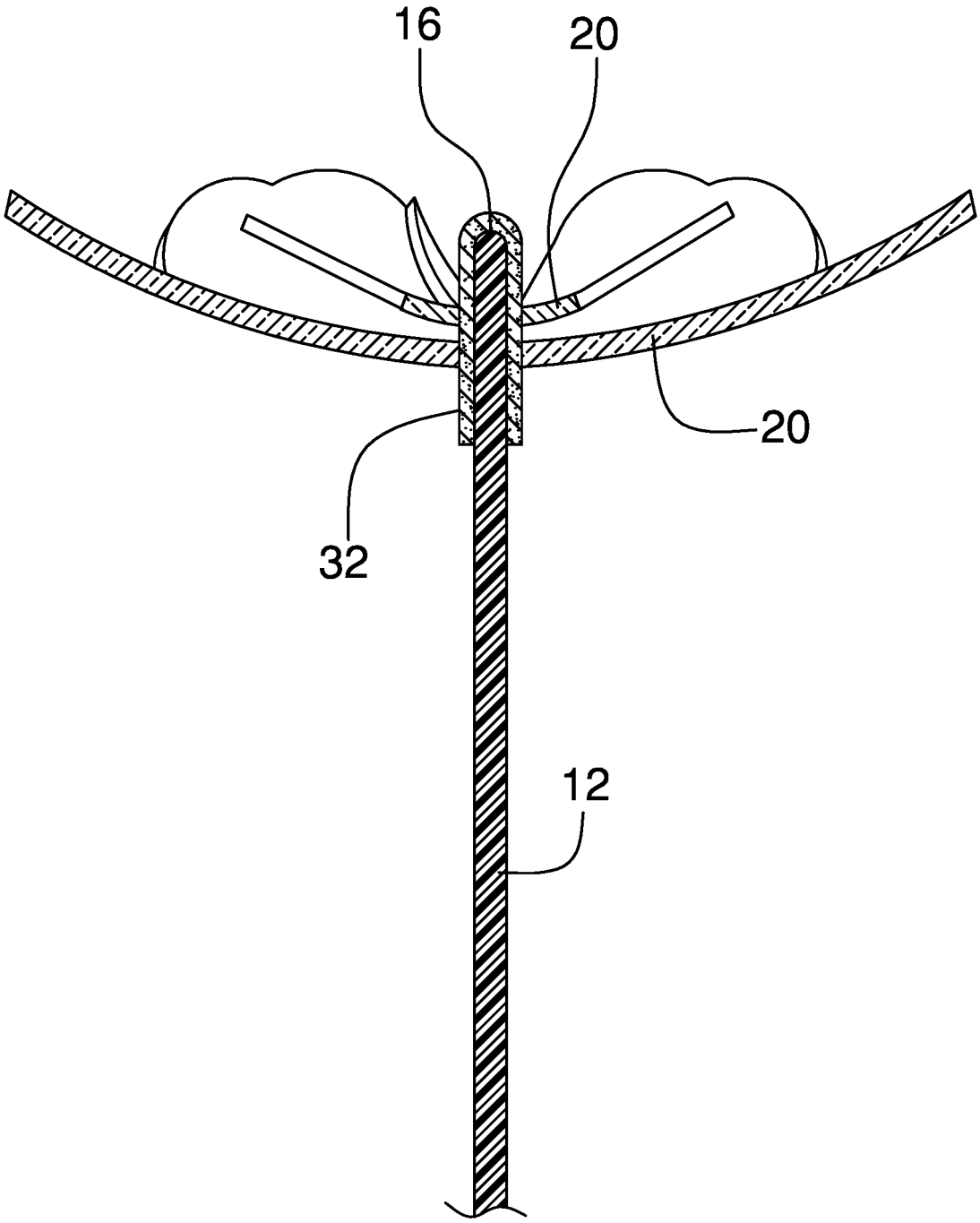
FIG. 4 is a cross-sectional view of an embodiment of the disclosure taken along line 4-4 of FIG. 3.
Figure 5:
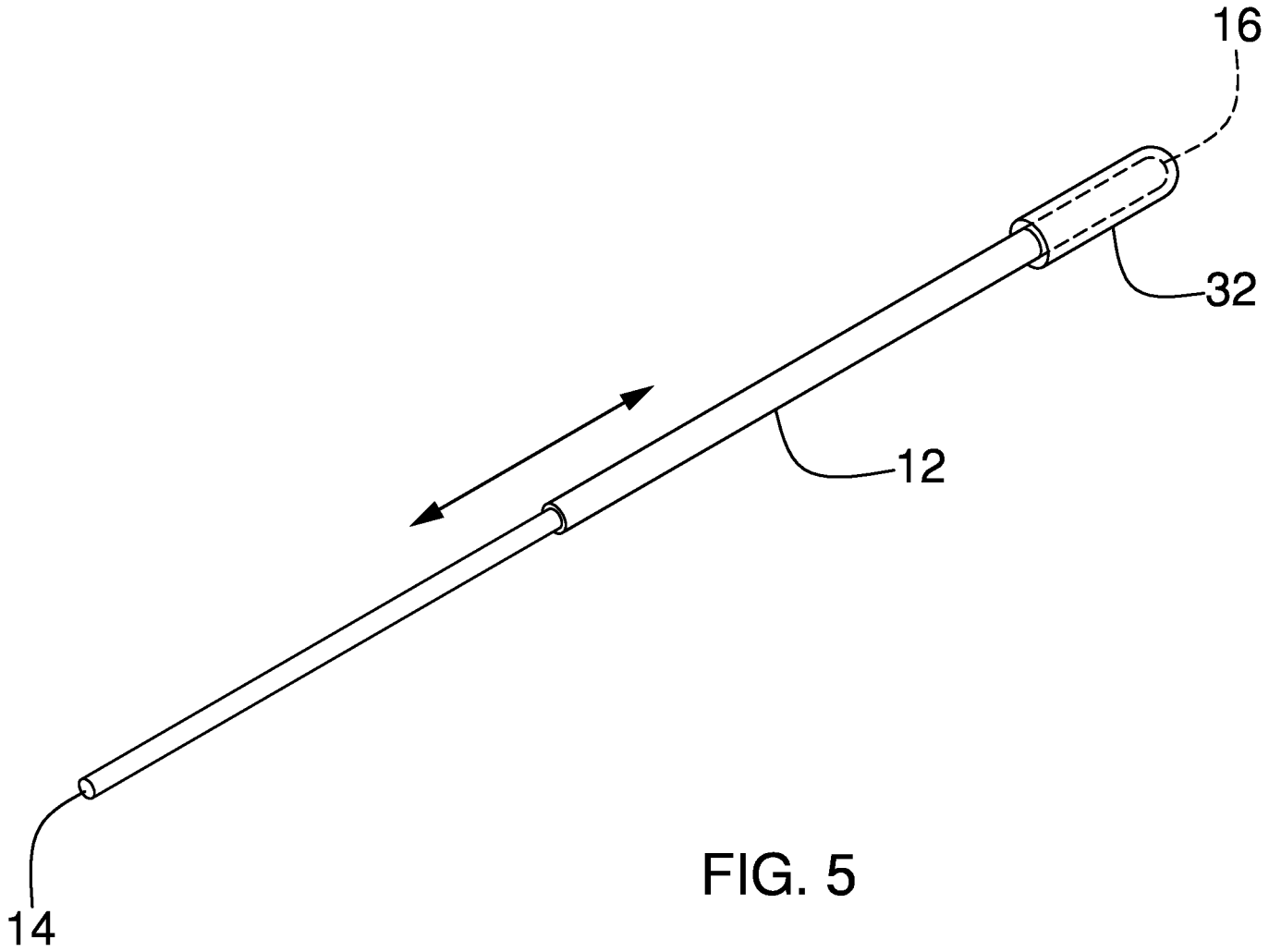
FIG. 5 is a side view of a support shaft of an embodiment of the disclosure.

As best illustrated in FIGS. 1 through 6, the light funneled illuminated edge decoration assembly 10 and method generally comprises a support shaft 12 having a bottom end 14 and a top end 16. The support shaft 12 has a height from the bottom end 14 to the top end 16 that is typically greater than 6.0 inches and will usually have a diameter no greater than 0.5 inches. In some embodiments such as shown in FIG. 5, the support shaft 12 is telescopic and has the height that is adjustable. The materials used to comprise the support shaft 12 may include rigid materials such as carbon composites, plastics, and metals. However, if plastic, the material should be one that is typically unaffected by ultra-violet light as such can cause some plastics and elastomers to degrade and become brittle, discolored, or, if clear, cloudy. Should the material be metallic, metals which are resistant or inert to water corrosion or oxidation, such as aluminum, may be preferred. While support shafts 12 of wooden materials may also be used, the ability of the support shaft 12 to remain intact and aesthetically pleasing throughout multiple seasons and after being subjected to inclement weather and sunshine is of importance, and, therefore, materials that will not decay or quickly become dilapidated are preferred.

A plurality of decorative elements 20 is provided for placement on the support shaft 12. Each decorative element 20 is formed from a single unitary panel and then shaped, as discussed further below. The decorative elements 20 each have a central area 22 having an aperture 24 extending therethrough. The support shaft 12 is thus able to be extended through the aperture 24 in each of the decorative elements 20 to allow the decorative elements 20 to be stacked on each other as shown in FIGS. 3 and 4. Each decorative element 20 has an upper surface 26 and a lower surface 28, wherein each of the upper 26 and lower 28 surfaces is non-planer. That is, the upper 26 and lower surface 28 each include areas of curvature including either, or both, convexly and concavely arcs. Thus, the decorative elements 20 are not planar across their entire upper 26 or lower 28 surfaces.

Each of the decorative elements 20 is comprised of a fluorescent acrylic material. This material is widely available and provides for unique properties along its free edges. Often this material is used in flat sheets for forming walls so that the walls appear to have illuminated edges. This occurs because as light enters the material through its upper 26 or lower 28 surfaces, some of the light is captured by reflection between the surfaces and "tunnels" to the free edges which gives the edges the appearance of glowing or emitting light. This is emission of light at the free edges is achievable using natural ambient light, while the remainder of the unitary panel remains in a non-glowing condition. The effect is made more apparent since the fluorescent acrylic material is colored and may be provided in virtually any color. If, for example, the material is red, the majority of the material will appear to be a standard, red, semi-transparent plastic, while the free edges will appear to be emitting intense red light.

The decorative elements 20 may be shaped as desired but in particular at least some of the decorative elements 20 are shaped as a flower and therefore includes a plurality of radiating pedals 30 extending outwardly from the central area 22. Other shapes may be formed and as such the aperture 24 may be located other than within a central area 22 of the unitary structure.

A retention member 32 is mounted on the support shaft 12 and releasably engages each of the decorative elements 20 positioned on the support shaft 12 to retain the decorative elements 20 on the support shaft 12. Each of the apertures 24 has a perimeter edge 26. The retention member 32 may, in particular, comprise a resiliently compressible material. The resiliently compressible material frictionally engages corresponding ones of the perimeter edges 34 to restrict vertical and rotational movement of the associated ones of the decorative elements 20. The retention member 32 is placed on the support shaft 12 at or near the top end 16 most typically and may have a closed end covering the top end 16. The retention member 32 is sized to have a diameter slightly larger than a diameter of the apertures 34 so that the retention member 32 is constricted where abutting the perimeter edge 34 of the decorative element 20. This constriction creates friction between the perimeter edge 34 and the retention member 32 to stop vertical movement on the support shaft 12 as well as prevention of the decorative element 20 relative to the support shaft 12. Materials typically used for this embodiment of the retention member 32 include natural and synthetic rubbers, silicone rubbers, compressible plastics, and the like.

In use, when forming the assemblies 10, the plurality of decorating elements 20 provided each has aperture 24 therein wherein the support shaft 12 is extended through the apertures 24 in one of the decorative elements 20 to mount the same on the support shaft 12. However, often there are multiple ones of the decorative elements 20 positioned on the support shaft 12 though most often the number of decorative elements 20 utilized with a single support shaft 12 varies from one to four decorative elements 20. The central area 22 of the lower surface 28 may often provide the lowest point of a decorative element 20. Thus, a height of the decorative elements 20 is most often determined from this location. When stacking, the height of the decorative elements 20 usually increases, in order of being stacked, from a lowermost decorative element 20 to a highest one of the decorative elements 20 to prevent the decorative elements 20 from touching each other except, perhaps, at their central areas 22. The retention member 32 extends through the apertures 24 and retains the decorative elements 20 where desired. The bottom end 14 of the support shaft 12 may then be extended into a conventional support surface, such as soil in a pot or garden or in dry foam used with artificial flowers, to retain the support shaft 12 in a generally vertical orientation. If telescopic, the support shaft 12 may have its length altered to a desired position.

To make the decorative elements 20, a sheet 40 of fluorescent acrylic material is utilized as the starting material. The sheet typically has a thickness, or height, from about 0.1 inches to 0.140 inches. One preferred thickness is from 0.118 inches to 0.122 inches. The length and width of the sheet 40 varies both upon the number of decorative elements 20 to be cut from the sheet 40 as well as availability of the sheets 40 from suppliers. Usually, a plurality of shapes are cut from the sheet and each of the shapes defines a planar element 42. A user may cut a single shape, or planar element 42, from the sheet 40 though economies of scale often dictate that multiple planar elements 42 are cut from the sheet 40 at one time. The planar elements 42 are cut from the sheet 40 in a conventional manner such as with a CNC waterjet table or CNC laser cutter. The apertures 24 are also often cut out at this time though the apertures 24 may instead be formed using a drill or heated element.

Figure 6:
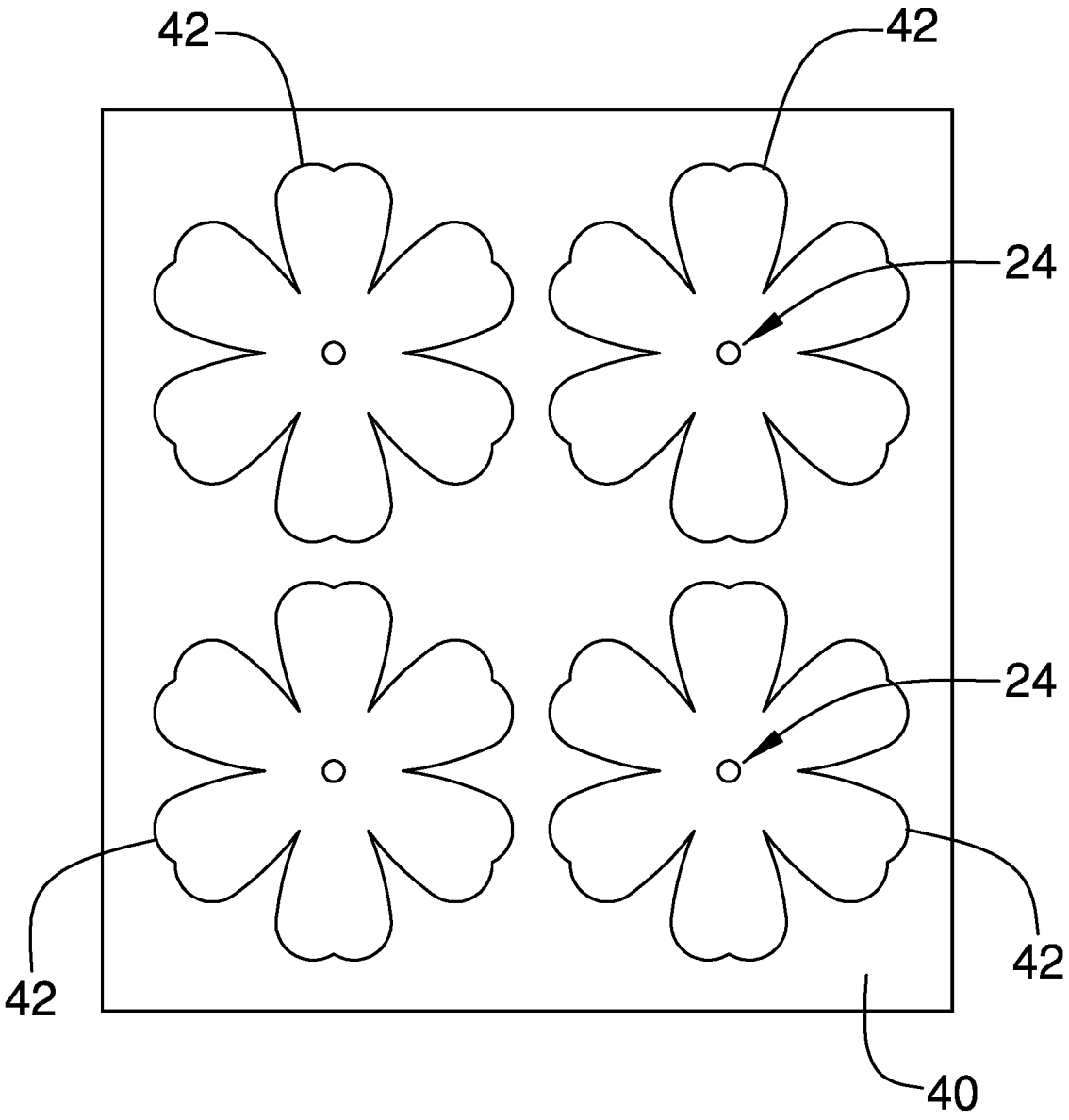
FIG. 6 is a top view of a plastic sheet and cut-outs therein of an embodiment of the disclosure.

The term "planar element" is being used as the sheets 40 are planar and therefore items cut therefrom are also planar. The shape to be cut out is dependent on the desired final outcome of the decorative element 20. Thus, the shape may appear to be a flower with a central area and a plurality of pedals as shown in FIG. 6. Other shapes, such as a humming bird, will require a flattened version of such that can later be formed as needed without the requirement of attaching embellishments which would render the decorative element less resistant to damage. However, any shapes including insects, birds, frogs, may be cut into a planar element 42.

After being removed from the sheet 40, the planar elements 42 are heated until they reach a temperature of malleability. This temperature is variable depending on the thickness of the material and the exact composition of the material, and is achieved when the planar elements 42 become bendable into a desired three-dimensional shape to create the final decorative element. In some embodiments, the planar elements 42 are heated to range of 255° F. to 275° F. Once the planar elements 42 reach the temperature of malleability, a user bends them into a desired configuration.

A user may utilize heat resistant gloves, variously shaped and sized tongs and pliers, other tools having surfaces for bending the planar element 42 against, and the like. Alternatively, the planar element 42, once heated sufficiently, may be pressed into a mold by hand, pestle, or the like and then removed once sufficiently shaped. Ultimately, portions of the planar element 42 are curved until the planar element resembles a flower or other desired plant, animal, or insect.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A method of assembling a garden decoration comprising the steps of:

providing a decorating element; and extending a support shaft through an aperture in the decorative element to mount the decorative element in on the support shaft, the decorative element being formed from a unitary panel such that the decorative element has an upper surface and a lower surface, each of the upper and lower surfaces being non-planer, the decorative element being comprised of a fluorescent acrylic material.

2. The method of assembling a garden decoration according to claim 1, further including the step of releasably retaining the decorative element on the support shaft with a retention member.

3. The method of assembling a garden decoration according to claim 1, wherein the step of retaining the decorative element on the support shaft further includes frictionally engaging a perimeter edge of the aperture with the retention member, the retention member comprising a resiliently compressible material extending around the support shaft.

4. The method of assembling a garden decoration according to claim 1, wherein the step of providing a decorative element further includes the steps of:

providing a sheet of fluorescent acrylic material;

cutting a shape from the sheet and defining the shape as a planar element;

heating the planar element; and shaping the planar element when the planar element has achieved a temperature of malleability to add curvature to portions of the upper and lower surfaces to define the decorative element.

5. A method of assembling a garden decoration comprising the steps of:

providing a plurality of decorating elements each having a centrally located aperture therein, each decorative element being formed from a unitary panel; and extending a support shaft through the apertures in at least two of the decorative elements to mount the decorative elements in on the support shaft, the decorative elements each having an upper surface and a lower surface, each of the upper and lower surfaces being non-planer, each of the decorative elements being comprised of a fluorescent acrylic material.

6. The method of assembling a garden decoration according to claim 5, further including the step of releasably retaining the decorative elements on the support shaft with a retention member.

7. The method of assembling a garden decoration according to claim 6, wherein the step of retaining the decorative elements on the support shaft further includes frictionally engaging a perimeter edge of the apertures with the retention member, the retention member comprising a resiliently compressible material extending around the support shaft.

8. The method of assembling a garden decoration according to claim 7, wherein the step of providing the decorative elements further includes the steps of:

providing a sheet of fluorescent acrylic material;

cutting a plurality of shapes from the sheet and defining the shapes as a planar element;

heating the planar elements; and shaping the planar elements when the planar elements have achieved a temperature of malleability to add curvature to portions of the upper and lower surfaces to define the decorative element, wherein at least some of the planar elements resemble flowers.

9. The method of assembling a garden decoration according to claim 5, wherein the step of providing the decorative elements further includes the steps of:

providing a sheet of fluorescent acrylic material;

cutting a plurality of shapes from the sheet and defining the shapes as a planar element;

heating the planar elements; and shaping the planar elements when the planar elements have achieved a temperature of malleability to add curvature to portions of the upper and lower surfaces to define the decorative element, wherein at least some of the planar elements resemble flowers.

* * * * *